US007237306B1

(12) United States Patent
Flowers et al.

(10) Patent No.: US 7,237,306 B1
(45) Date of Patent: Jul. 3, 2007

(54) CLIP AND TROUSER COMBINATION

(76) Inventors: Vinson Flowers, 9407 Kings Hwy., Apt. 4H, Brooklyn, NY (US) 11212; Kiamesha Rogers, 9407 Kings Hwy., Apt. 4H, Brooklyn, NY (US) 11212

( * ) Notice: Subject to any disclaimer, the term of this patent is extended or adjusted under 35 U.S.C. 154(b) by 0 days.

(21) Appl. No.: 11/086,686

(22) Filed: Mar. 22, 2005

(51) Int. Cl.
*A41F 17/02* (2006.01)

(52) U.S. Cl. ..... 24/72.1; 24/564

(58) Field of Classification Search ..... 24/560, 24/545, 530, 555, 546, 563, 564, 72.1; 2/232, 2/269

See application file for complete search history.

(56) References Cited

U.S. PATENT DOCUMENTS

| | | | | | |
|---|---|---|---|---|---|
| 271,891 | A * | 2/1883 | McDermott | 24/316 |
| 492,514 | A * | 2/1893 | Leavitt | 2/232 |
| 2,107,516 | A * | 2/1938 | Bishop | 24/72.1 |
| 2,129,494 | A * | 9/1938 | Julius | 24/265 R |
| 2,146,190 | A * | 2/1939 | Luke | 24/482 |
| 2,583,861 | A * | 1/1952 | Lewallen | 2/232 |
| 2,632,619 | A * | 3/1953 | Wilson | 248/316.7 |
| 4,602,389 | A | 7/1986 | Brown | |
| 4,793,030 | A * | 12/1988 | Hirsch | 24/265 WS |
| 4,825,475 | A | 5/1989 | Smart | |
| 5,787,511 | A | 8/1998 | Garside | |
| 6,393,675 | B1 * | 5/2002 | Gaetke | 24/563 |
| 6,618,862 | B1 | 9/2003 | Bunjes | |
| 6,701,582 | B1 | 3/2004 | Milburn | |
| 6,829,847 | B2 | 12/2004 | O'Shea et al. | |

* cited by examiner

*Primary Examiner*—James R. Brittain
(74) *Attorney, Agent, or Firm*—Harvey Lunenfeld

(57) ABSTRACT

An aesthetically pleasing fastener for allowing a desired height of a hem of a pants leg to be maintained and repeatedly changed without compromising structural integrity of the pants leg or having to cooperate with a shoe so as to allow the fastener to be used without a need for a shoe. The aesthetically pleasing fastener includes a clip and a covering. The covering covers the clip. The clip receives the hem of the pants leg and allows the desired height of the hem of the pants leg to be maintained and repeatedly changed without compromising the structural integrity of the pants leg or having to cooperate with a shoe so as to allow the fastener to be used without a need for a shoe, while the covering makes the aesthetically pleasing fastener aesthetically pleasing.

5 Claims, 2 Drawing Sheets

CLIP AND TROUSER COMBINATION

BACKGROUND OF THE INVENTION

1. Field of the Invention

The present invention relates to a fastener for allowing a desired height of a hem of a pants leg to be maintained, and more particularly, the present invention relates to an aesthetically pleasing fastener for allowing a desired height of a hem of a pants leg to be maintained and repeatedly changed without compromising structural integrity of the pants leg or having to cooperate with a shoe so as to allow the fastener to be used without a need for a shoe.

2. Description of the Prior Art

As shown in FIG. 1, which is a diagrammatic perspective view of the bottoms of the legs of a pair of pants dragging on the ground, present fashion styles include pants 10 that have a longer length. In particular, extra baggy, long pants 10 have become stylish. When walking while wearing this type of pants 10, it is common for the bottoms 12 of the legs 14 of the pants 10 to get caught under the heels 16 of a person's shoes 18. Besides causing the pants 10 to get dirty from dragging on the ground 19, it is also possible for the bottoms 12 of the legs 14 of the pants 10 to be ripped. Once ripped, it is often necessary to discard the garment.

Thus, there exists a need for an aesthetically pleasing fastener for allowing a desired height of a hem of a pants leg to be maintained and repeatedly changed without compromising structural integrity of the pants leg or having to cooperate with a shoe so as to allow the fastener to be used without a need for a shoe.

Numerous innovations for pants leg related devices have been provided in the prior art. Even though these innovations may be suitable for the specific individual purposes to which they address, they each differ in structure and/or operation and/or purpose from the present invention in that they do not teach an aesthetically pleasing fastener for allowing a desired height of a hem of a pants leg to be maintained and repeatedly changed without compromising structural integrity of the pants leg or having to cooperate with a shoe so as to allow the fastener to be used without a need for a shoe.

FOR EXAMPLE, U.S. Pat. No. 4,602,389 issued to Brown on Jul. 29, 1986 teaches a hem retainer including a strip of flexible material which has a series of first and second engagement portions. At least one of the first engagement portions is engageable with at least one of the second engagement portions to hold the strip of flexible material in a circular configuration. Also taught is a method of forming a cuff on a pants leg or the like, the pants leg having an inside surface, an outside surface, and an opening. The operator first measures the desired length of the pants leg, turns the pants leg inside out, and then turns the excess length of the leg back on the inside surface of the pants leg. The hem retainer is formed into a circular configuration which is then inserted within the pants leg, adjacent the opening, stretching the pants leg around the hem retainer by adjusting the circumference of the hem retainer. The operator can then sew the excess pants length to the inside surface of the pants leg forming a cuff.

ANOTHER EXAMPLE, U.S. Pat. No. 4,825,475 issued to Smart on May 2, 1989 teaches a pants leg restraining band which is somewhat like a removable cuff for the lower end of the pants leg. The unit will ordinarily come in pairs, and includes a band, which may be elastic, and which defines spaced, inverted pockets which receive plastic clips to clip onto the pants leg. The band has hook and loop fastener material so that it can be wrapped around the bottom of the pants leg and engaged on itself to peg the pants.

STILL ANOTHER FOR EXAMPLE, U.S. Pat. No. 5,787,511 issued to Garside on Aug. 4, 1998 teaches a temporary hemming device that includes a flexible member having a first end and a second end and being made of a material which feels comfortable on the skin, and a fastening device for fastening the first end to the second end through a garment. The fastening device includes a first part and a second part. The first part is attached to the first end and the second part is attached to the second end. A method for making a temporary hem includes folding an edge of a garment, placing a temporary hemming device over the folded edge, and affixing the temporary hemming device to make the temporary hem. A temporary hemming device includes a folded edge of a garment and a temporary hemming device securing the folded edge in place.

YET ANOTHER EXAMPLE, U.S. Pat. No. 6,618,862 issued to Bunjes on Sep. 16, 2003 teaches a pants hem guard, for attachment to a shoe and having a frame with a U-shaped inner portion and a U-shaped outer portion, and a clip insert attached to the outer portion of the frame. The outer portion has two ends attached to a rear surface of the clip insert. A pair of horizontal members connect the inner and outer portions so that the frame is one continuous piece. The guard is attached to the back portion of a shoe, with the clip insert remaining on the outside of the shoe just above the shoe heel. A pants hem is tucked behind the clip insert and keeps the hem above the shoe heel.

STILL YET ANOTHER EXAMPLE, U.S. Pat. No. 6,701,582 issued to Milburn on Mar. 9, 2004 teaches a trouser leg retaining device which is used for maintaining one's trouser legs in the proper position in relation to one's shoes. Included is an elongated elastic strap with a snap fastener device at one end and either a locking clip or an O-ring at the opposite end. The snap fastens onto one's trouser leg while the O-ring fastens onto one's shoe. The elastic strap has an adjuster positioned on it to adjust the length of the strap.

YET STILL ANOTHER EXAMPLE, U.S. Pat. No. 6,829,847 issued to O'Shea et al. on Dec. 14, 2004 teaches a pants cuff protector for use with long pants for holding a cuff of a pants leg away from the ground. The protector includes a first clamping body affixed proximate a wearer's ankle, a second clamping body magnetically attractable to the first clamping body, and optionally a strap therebetween.

It is apparent that numerous innovations for pants leg related devices have been provided in the prior art that are adapted to be used. Even though these innovations may be suitable for the specific individual purposes to which they address, they would not be suitable for the purposes of the present invention as heretofore described since they do not teach an aesthetically pleasing fastener for allowing a desired height of a hem of a pants leg to be maintained and repeatedly changed without compromising structural integrity of the pants leg or having to cooperate with a shoe so as to allow the fastener to be used without a need for a shoe.

SUMMARY OF THE INVENTION

ACCORDINGLY, AN OBJECT of the present invention is to provide an aesthetically pleasing fastener for allowing a desired height of a hem of a pants leg to be maintained and repeatedly changed without compromising structural integrity of the pants leg or having to cooperate with a shoe so as to allow the fastener to be used without a need for a shoe that avoids the disadvantages of the prior art.

ANOTHER OBJECT of the present invention is to provide an aesthetically pleasing fastener for allowing a desired height of a hem of a pants leg to be maintained and repeatedly changed without compromising structural integrity of the pants leg or having to cooperate with a shoe so as to allow the fastener to be used without a need for a shoe that is simple to use.

BRIEFLY STATED, STILL ANOTHER OBJECT of the present invention is to provide an aesthetically pleasing fastener for allowing a desired height of a hem of a pants leg to be maintained and repeatedly changed without compromising structural integrity of the pants leg or having to cooperate with a shoe so as to allow the fastener to be used without a need for a shoe. The aesthetically pleasing fastener includes a clip and a covering. The covering covers the clip. The clip receives the hem of the pants leg and allows the desired height of the hem of the pants leg to be maintained and repeatedly changed without compromising the structural integrity of the pants leg or having to cooperate with a shoe so as to allow the fastener to be used without a need for a shoe, while the covering makes the aesthetically pleasing fastener aesthetically pleasing.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

Figure 1:
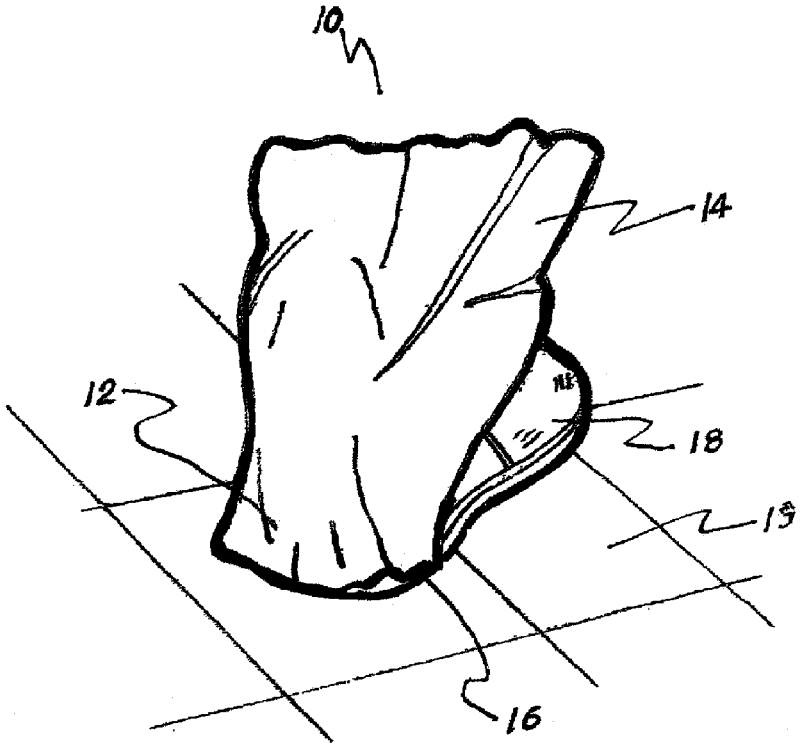
Figure 2:
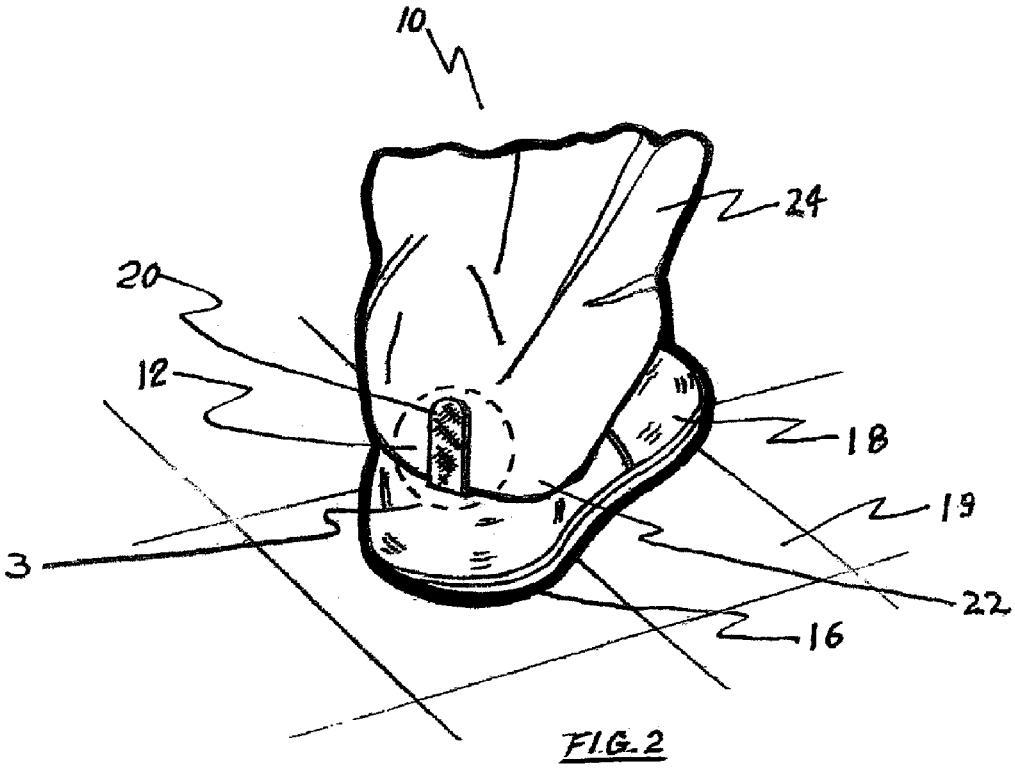
Figure 3:
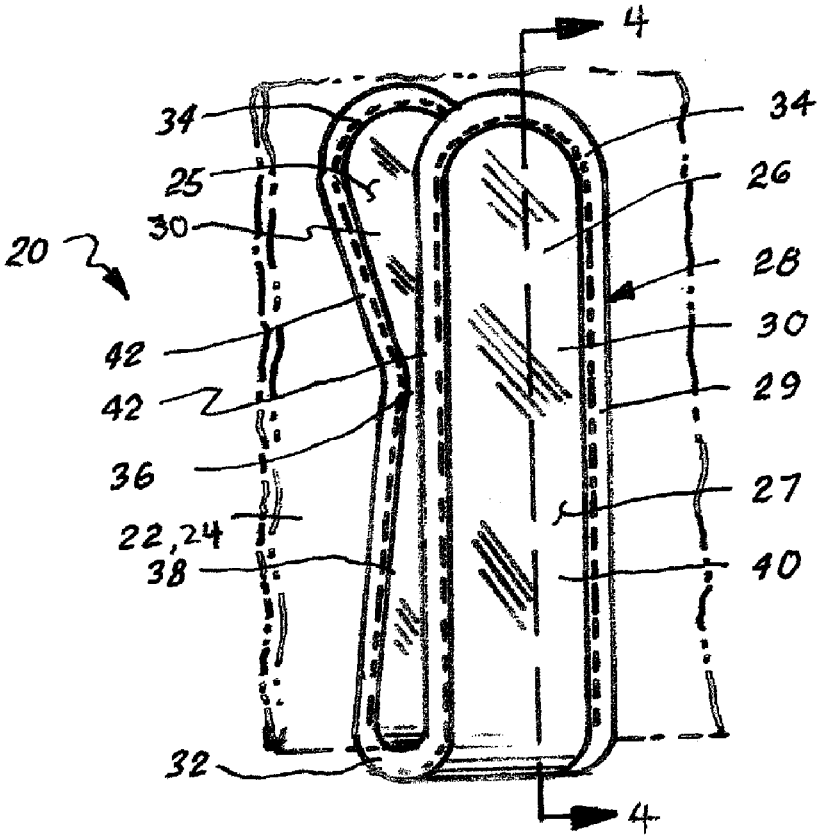
Figure 4:
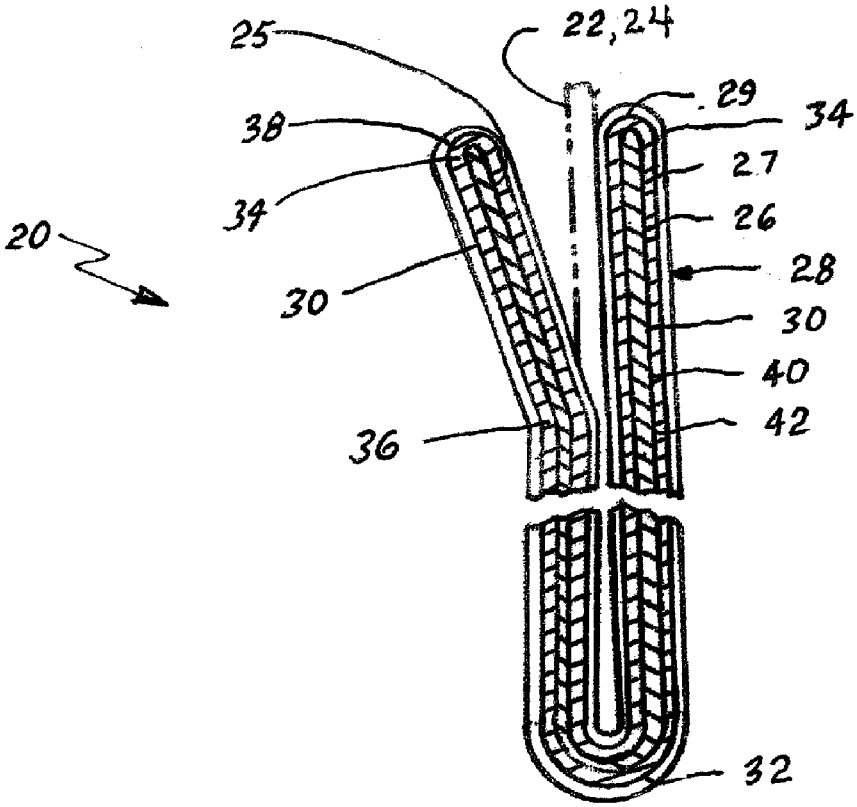

| | |
|---|---|
| FIG. 1 | is a diagrammatic perspective view of the bottoms of the legs of a pair of pants dragging on the ground; |
| FIG. 2 | is a diagrammatic perspective view of the aesthetically pleasing fastener of the present invention allowing a desired height of a hem of a pants leg to be maintained and repeatedly changed without compromising structural integrity of the pants leg or having to cooperate with a shoe so as to allow the fastener to be used without a need for a shoe; |
| FIG. 3 | is an enlarged diagrammatic perspective view of the area generally enclosed by the dotted curve identified by ARROW 3 in FIG. 2 of the aesthetically pleasing fastener of the present invention; and |
| FIG. 4 | is an enlarged diagrammatic cross sectional view taken along LINE 4-4 in FIG. 3 |

LIST OF REFERENCE NUMERALS UTILIZED IN THE DRAWING

Prior Art

| | |
|---|---|
| 10 | pants |
| 12 | bottoms of legs 14 of pants 10 |
| 14 | legs of pants 10 |
| 16 | heels of shoes 18 |
| 18 | shoes |
| 19 | ground |

Present Invention

| | |
|---|---|
| 20 | aesthetically pleasing fastener of present invention for allowing desired height of hem 22 of pants leg 24 to be maintained and repeatedly changed without compromising structural integrity of pants leg 24 or having to cooperate with shoe so as to allow fastener 20 to be used without need for shoe |
| 22 | hem of pants leg 24 |
| 24 | pants leg |
| 25 | interior surfaces of clip 26 |
| 26 | clip for receiving hem 22 of pants leg 24 and for allowing desired height of hem 22 of pants leg 24 to be maintained and repeatedly changed without compromising structural integrity of pants leg 24 or having to cooperate with shoe so as to allow fastener 20 to be used without need for shoe |
| 27 | exterior surfaces of clip 26 |
| 28 | covering |
| 29 | edges of clip 26 |
| 30 | pair of legs of clip 26 |
| 32 | common end of pair of legs 30 of clip 26 |
| 34 | pair of free ends of pair of legs 30 of clip 26, respectively |
| 36 | transition point of other leg of pair of legs 30 of clip 26 for abutting hem 22 of pants leg 24 |
| 38 | inner portion of covering 28 |
| 40 | outer portion of covering 28 |
| 42 | edging/binding of covering 28 |

DETAILED DESCRIPTION OF THE PREFERRED EMBODIMENT

Referring now to the figures, in which like numerals indicate like parts, and particularly to FIG. 2, which is a diagrammatic perspective view of the aesthetically pleasing fastener of the present invention allowing a desired height of a hem of a pants leg to be maintained and repeatedly changed without compromising structural integrity of the pants leg or having to cooperate with a shoe so as to allow the fastener to be used without a need for a shoe, the aesthetically pleasing fastener of the present invention is shown generally at 20 for allowing a desired height of a hem 22 of a pants leg 24 to be maintained and repeatedly changed without compromising structural integrity of the pants leg 24 or having to cooperate with a shoe so as to allow the fastener 20 to be used without a need for a shoe.

The specific configuration of the fastener 20 can best be seen in FIGS. 3 and 4, which are, respectively, an enlarged diagrammatic perspective view of the area generally enclosed by the dotted curve identified by ARROW 3 in FIG. 2 of the aesthetically pleasing fastener of the present invention, and, an enlarged diagrammatic cross sectional view taken along LINE 4—4 in FIG. 3, and as such, will be discussed with reference thereto.

The aesthetically pleasing fastener 20 comprises a clip 26 and a covering 28. The covering 28 covers the clip 26. The clip 26 is for receiving the hem 22 of the pants leg 24 and for allowing the desired height of the hem 22 of the pants leg 24 to be maintained and repeatedly changed without compromising the structural integrity of the pants leg 24 or having to cooperate with a shoe so as to allow the fastener 20 to be used without a need for a shoe, while the covering 28 makes the aesthetically pleasing fastener 20 aesthetically pleasing.

The clip 26 is preferably made from metal or plastic, but is not limited to that, is substantially U-shaped and one-piece and has interior surfaces 25, exterior surfaces 27, edges 29, and a pair of legs 30 with a common end 32 and a pair of free ends 34, respectively. The pair of legs 30 of the clip 26 overlie each other and are joined to each other at the common end 32 thereof. The common end 32 of the pair of legs 30 of the clip 26 has slight resiliency. The pair of free ends 34 of the pair of legs 30 of the clip 26, respectively, are rounded for safety and for not puncturing the covering 28.

The common end 32 of the pair of legs 30 of the clip 26 spaces the pair of legs 30 of the clip 26 slightly apart from each other for allowing the hem 22 of the pants leg 24 to be replaceably positioned between the pair of legs 30 of the clip 26, while the pair of legs 30 of the clip 26 allow the desired height of the hem 22 of the pants leg 24 to be maintained and repeatedly changed without compromising the structural integrity of the pants leg 24 or having to cooperate with a shoe so as to allow the fastener 20 to be used without a need for a shoe by virtue of the pair of legs 30 of the clip 26 compressing against the hem 22 of the pants leg 24 as a result of the slight resiliency of the common end 32 of the pair of legs 30 of the clip 26.

One leg 30 of the clip 26 is for abutting the pants leg 24, while the other leg 30 of the clip 26 is for abutting the hem 22 of the pants leg 24. The one leg 30 of the clip 26 is narrow and substantially flat. The other leg 30 of the clip 26 is narrow and extends from the common end 32 of the pair of legs 30 of the clip 26, inwardly towards the one leg 30 of the clip 26, then transitions therefrom at a transition point 36 thereof, outwardly away from the one leg 30 of the clip 26, to the free end 34 thereof.

The transition point 36 of the other leg 30 of the clip 26 is arcuate for not compromising the structural integrity of the pants leg 24 since the transition point 36 of the other leg 30 of the clip 26 is for abutting the hem 22 of the pants leg 24. The common end 32 of the pair of legs 30 of the clip 26 is arcuate for allowing only the transition point 36 of the other leg 30 of the clip 26 to abut the hem 22 of the pants leg 24.

The covering 28 overlyingly covers all surfaces of the clip 26 in their entireties, i.e., the interior surfaces 25 of the clip 26, the exterior surfaces 27 of the clip 26, and the edges 29 of the clip 26, preferably by stitches or glue, but is not limited to that, for aesthetics and for preventing the clip 26 from damaging the pants leg 24. The covering 28 is preferably made of a fabric, but is not limited to that, and preferably matches that of the pants leg 24 for being less visible or does not match that of the pants leg 24 for decorative purposes depending on preference of the intended user.

The covering 28 includes an inner portion 38, an outer portion 40, and edging/binding 42. The inner portion 38 of the covering 28 overlyingly covers the interior surfaces 25 of the clip 26, the outer portion 40 of the covering 28 overlyingly covers the exterior surfaces 27 of the clip 26, and the edging/binding 42 of the covering 28 overlyingly covers the edges 29 of the clip 26 and connects the inner portion 38 of the covering 28 to the outer portion 40 of the covering 28.

It will be understood that each of the elements described above, or two or more together, may also find a useful application in other types of constructions differing from the types described above.

While the invention has been illustrated and described as embodied in an ascetically pleasing fastener for allowing a desired height of a hem of a pants leg to be maintained and repeatedly changed without compromising structural integrity of the pants leg or having to cooperate with a shoe, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A clip and trouser combination, comprising:

a trouser leg having a hem;

a clip having an outer leg, an inner leg, and a resilient arcuate shaped connecting portion, connecting said outer leg and said inner leg, biasing said outer leg and said inner leg one toward the other and removably fastening said clip to said hem, said outer leg having a first distal end, said inner leg having a second distal end angularly bent to form a guide to facilitate insertion of said hem into said clip, when said clip is placed about said hem and directed toward said hem, said outer leg is of a substantially planar material, said inner leg has said second distal end angularly bent and directed away from said first distal end of said outer leg, said first distal end of said outer leg is arcuate shaped, said second distal end of said inner leg is arcuate shaped, said outer leg, said inner leg, and said resilient arcuate shaped connecting portion are formed from a one piece substantially planar material;

said clip comprising an exteriorly disposed surface, an interiorly disposed surface, and an edge adjoining said exteriorly disposed surface and said interiorly disposed surface, said clip having an exteriorly disposed fabric fastened to said exteriorly disposed surface, an interiorly disposed fabric fastened to said interiorly disposed surface, and a binding adjacent said edge fastening said exteriorly disposed fabric to said interiorly disposed fabric;

said exteriorly disposed fabric is fastened to said exteriorly disposed surface with glue, said interiorly disposed fabric is fastened to said interiorly disposed surface with glue.

2. A clip and trouser combination, comprising:

a trouser leg having a hem;

a clip having an outer leg, an inner leg, and a resilient arcuate shaped connecting portion, connecting said outer leg and said inner leg, biasing said outer leg and said inner leg one toward the other and removably fastening said clip to said hem, said outer leg having a first distal end, said inner leg having a second distal end angularly bent to form a guide to facilitate insertion of said hem into said clip, when said clip is placed about said hem and directed toward said hem, said outer leg is of a substantially planar material, said inner leg has said second distal end angularly bent and directed away from said first distal end of said outer leg, said first distal end of said outer leg is arcuate shaped, said second distal end of said inner leg is arcuate shaped, said outer leg, said inner leg, and said resilient arcuate shaped connecting portion are formed from a one piece substantially planar material;

said clip comprising an exteriorly disposed surface, an interiorly disposed surface, and an edge adjoining said exteriorly disposed surface and said interiorly disposed surface, said clip having an exteriorly disposed fabric fastened to said exteriorly disposed surface, an interiorly disposed fabric fastened to said interiorly disposed surface, and a binding adjacent said edge fastening said exteriorly disposed fabric to said interiorly disposed fabric;

said binding has first stitches and second stitches, said first stitches fasten said binding to said exteriorly disposed fabric one to the other, said second stitches fasten said binding to said interiorly disposed fabric one to the other, said exteriorly disposed fabric is fastened to said exteriorly disposed surface with glue, said interiorly disposed fabric is fastened to said interiorly disposed surface with glue.

3. A clip and trouser combination, comprising:

a trouser leg having a hem;

a clip having an outer leg, an inner leg, and a resilient arcuate shaped connecting portion, connecting said outer leg and said inner leg, biasing said outer leg and said inner leg one toward the other and removably fastening said clip to said hem, said outer leg having a first distal end, said inner leg having a second distal end angularly bent to form a guide to facilitate insertion of said hem into said clip, when said clip is placed about said hem and directed toward said hem, said outer leg is of a substantially planar material, said inner leg has said second distal end angularly bent and directed away from said first distal end of said outer leg, said first distal end of said outer leg is arcuate shaped, said second distal end of said inner leg is arcuate shaped said inner leg is interiorly disposed to said trouser leg and said outer leg is exteriorly disposed to said trouser leg, when said hem is inserted into said clip, said outer leg, said inner leg, and said resilient arcuate shaped connecting portion are formed from a one piece substantially planar material;

said clip comprising an exteriorly disposed surface, an interiorly disposed surface, and an edge adjoining said exteriorly disposed surface and said interiorly disposed surface, said clip having an exteriorly disposed fabric fastened to said exteriorly disposed surface, an interiorly disposed fabric fastened to said interiorly disposed surface, and a binding adjacent said edge fastening said exteriorly disposed fabric to said interiorly disposed fabric;

said binding has first stitches and second stitches, said first stitches fasten said binding to said exteriorly disposed fabric one to the other, said second stitches fasten said binding to said interiorly disposed fabric one to the other, said exteriorly disposed fabric is fastened to said exteriorly disposed surface with glue, said interiorly disposed fabric is fastened to said interiorly disposed surface with glue;

said trouser leg is fabricated from a trouser fabric, said exteriorly disposed fabric is fabricated from the same fabric as said trouser fabric.

4. The combination of claim 3, wherein:

said one piece substantially planar material is a metal.

5. The combination of claim 3, wherein:

said one piece substantially planar material is a plastic.

* * * * *